US005620377A

United States Patent [19]

Glockner

[11] Patent Number: 5,620,377

[45] Date of Patent: Apr. 15, 1997

[54] GOLF CLUB INCLUDING REMOVABLY ATTACHED GROUND ENGAGEABLE GUIDE SURFACE

[76] Inventor: Dieter Glockner, Hofackerweg 29, 91126 Schwabach, Germany

[21] Appl. No.: 577,273

[22] Filed: Dec. 22, 1995

[30] Foreign Application Priority Data

Dec. 29, 1994 [DE] Germany ..... 44 47 084.3

[51] Int. Cl.[6] ..... A63B 69/36

[52] U.S. Cl. ..... 473/238; 473/230; 473/328

[58] Field of Search ..... 473/230, 231, 473/232, 242, 244, 260, 286, 408, 238, 328

[56] References Cited

U.S. PATENT DOCUMENTS

| | | | |
|---|---|---|---|
| 1,644,392 | 10/1927 | Myers | 473/260 X |
| 1,657,322 | 1/1928 | Shinn | 473/286 X |
| 3,044,781 | 7/1962 | Murphy | 473/230 |
| 3,844,569 | 10/1974 | Swanson | 473/231 |
| 4,688,799 | 8/1987 | Johnson | 473/230 |

*Primary Examiner*—George J. Marlo
*Attorney, Agent, or Firm*—Friedrich Kueffner

[57] ABSTRACT

A golf club includes a shaft and a head with a club face connected to the lower end of the shaft. A ground engageable guide surface is provided on the head. The guide surface is mounted laterally next to the face of the head and extends toward the front and toward the top. The guide surface may be mounted so as to be adjustable relative to the head or the shaft of the club. The guide surface is mounted on an intermediate piece which is removably attached to the shaft on a side of the head facing away from the club face of the head. The guide surface may be formed by a resilient plate-shaped member.

5 Claims, 1 Drawing Sheet

GOLF CLUB INCLUDING REMOVABLY ATTACHED GROUND ENGAGEABLE GUIDE SURFACE

BACKGROUND OF THE INVENTION

1. Field of the Invention

The present invention relates to a golf club which includes a shaft and a head with a club face connected to the lower end of the shaft. A guide surface is provided on the head.

2. Description of the Related Art

In the game of golf, novices or beginners always have at least at the beginning the problem of guiding the club held at the grip of the club shaft in such a way that the club head assumes an optimum position relative to the ball. However, in the beginning, the club and, thus, the club head are usually held too deep, which means that the club head contacts and damages the fairway even before the club head hits the ball. This may lead to holes in the fairway which subsequently must be repaired in an expensive manner. Moreover, when the club head hits the ground of the fairway which does not yield to a great extent, injuries to the elbow and/or to the wrist joints may occur. The accuracy with which the ball is hit and, thus, the quality of the stroke are significantly impaired.

U.S. Pat. No. 3,997,171 discloses a golf club which is provided with a guide surface on the rear side thereof. This guide surface cannot prevent novices of the game of golf from holding the club and, thus, the head too deep and from hitting the ground. The attendant danger of injuries to elbow and/or wrist joints is also not eliminated. In addition, the guide surface on the rear side of the club does not have any influence on the accuracy with which the ball is hit and on the quality of the strokes.

Japanese Patent Application 1-227 774 discloses a club at whose head a rail body is mounted which is composed of two rail components which are arranged spaced apart from each other. The ball carries out a movement between the two rail components; the purpose is to always ensure that the ball contacts the ground and that the rail components have a predetermined distance from the ground. Because of the distance from the ground, rail components of this type, which may extend over an angle of approximately 45°, do not constitute a guide surface for the head.

SUMMARY OF THE INVENTION

Therefore, it is the primary object of the present invention to provide a golf club which is constructed in such a way that the accuracy of hitting the ball is improved especially for beginners and injuries to joints and damage to the ground are prevented.

In accordance with the present invention, in a golf club of the above-described type, the guide surface is mounted laterally next to the face of the head and extends toward the front and toward the top.

The guide surface constructed according to the present invention acts like the runner of a sled and causes the head of the club to slide on the ground without damaging the ground. Holes in the fairway can no longer occur. Since the club head slides on the ground because of the guide surface, the club head does not hit the ground, so that injuries to the elbow and/or wrist joints are essentially excluded. The accuracy of hitting the ball is improved, which inevitably leads to better and longer strokes.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
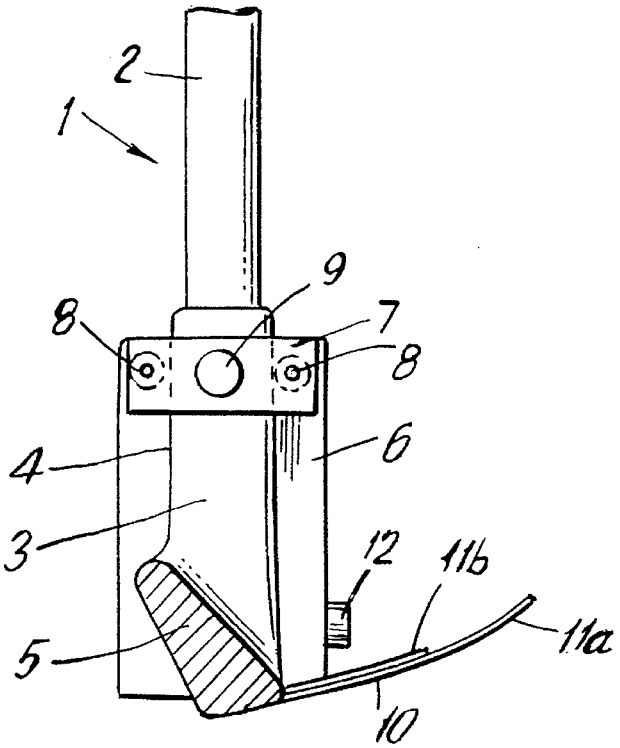
FIG. 1 is a schematic view, partially in section, of the lower portion of a golf club with a guide surface.

FIG. 1 of the drawing shows of a conventional golf club 1 only the lower portion of the shaft 2. The head 3 of the golf club 1 is connected to the shaft 2 through a neck 4. In order to improve the clarity of the illustration, the sectional view of FIG. 1 is taken across the portion of the head 3 with the club face 5 close to the neck 4.

On the side of the neck 4 facing away from the club face 5, an intermediate piece 6, for example, of metal or synthetic material, is attached to the neck 4. The intermediate piece 6 is attached to the neck 4 by means of a stirrup 7 which is connected with the intermediate piece 6 by means of schematically indicated screws 8 so as to surround the neck 4. If necessary, the intermediate piece 6 may be clamped at the neck 4 of the head 3 by means of these screws 8. However, it is also possible to construct a guide member for the neck 4 of the head 3 between the intermediate piece 6 and the stirrup 7 and to secure the intermediate piece 6 and the stirrup by means of an additional clamping screw 9 to the neck 4 of the head 3. This makes it possible to change and adjust the vertical position of the intermediate piece 6 on the neck 4.

The intermediate piece 6 is provided at its bottom side with a guide surface 10 which, as illustrated in FIG. 1, is formed by two leaf springs 11*a*, 11*b*, of different length. The guide surface 10 extends toward the front and toward the top as seen in the direction in which the ball is hit by the club. The shorter leaf spring 11*b*, which is not absolutely necessary, contributes to the stabilization of the longer leaf spring 11*a*. Both leaf springs 11*a*, 11*b* are fastened to the intermediate piece 6 by means of a schematically indicated screw 12. This fastening is constructed in the conventional manner in such a way that the leaf springs 11*a*, 11*b* can be pivoted at least slightly about the axis of the screw 12. However, it is also possible to connect the leaf springs 11*a*, 11*b* to the intermediate piece 6 through a ball-and-socket joint which can be tightened by the screw 12. This makes it possible that the guide surface 10 can be adjusted into essentially any desired position relative to the club face 5.

The use of leaf springs 11*a*, 11*b* for forming the guide surface 10 produces a damping effect when the club head unintentionally hits the fairway when carrying out a stroke. The guide surface 10 additionally may be constructed so as to be outwardly arched or spherically shaped in a direction perpendicular to the plane of the drawing.

Figure 2:
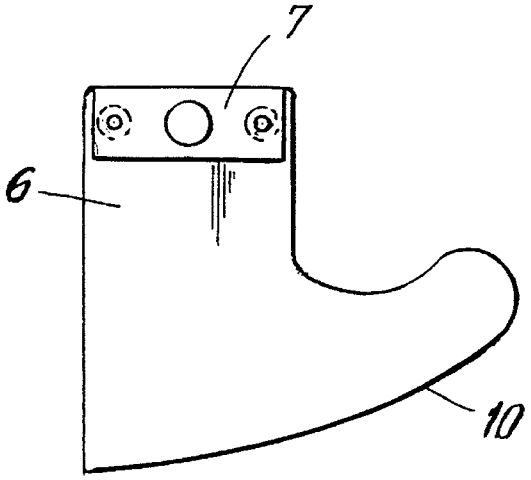
FIG. 2 is an elevational view of another guide surface.

FIG. 2 of the drawing shows an intermediate piece 6 with a stirrup 7, wherein the intermediate piece is of synthetic material and has a shoe-shaped configuration. The guide surface 10 is provided directly at the bottom side of the intermediate piece 6. This guide surface 10 may also be outwardly arched perpendicularly to the plane of the drawing. However, this configuration makes it no longer possible to adjust the position of the guide surface 10 independently of the position of the intermediate piece 6.

In a modification of the above-explained embodiment, it is also possible to cast the intermediate pieces 6 supporting or forming the guide surface 10 directly to the head 3 of the golf club 1. Of course, in that case, the head 3 and the intermediate pieces 6 are of the same material. However, in that case, it is also not possible to adjust the guide surface 10.

While specific embodiments of the invention have been shown and described in detail to illustrate the inventive principles, it will be understood that the invention may be embodied otherwise without departing from such principles.

I claim:

1. A golf club comprising a shaft having a lower end, a head having a club face attached to the lower end of the shaft, and an intermediate piece removably attached to the shaft on a side of the shaft facing away from the club face of the head, the intermediate piece being adjustable in a vertical position thereof relative to the head, the intermediate piece comprising a ground engageable guide surface extending upwardly and forwardly from the head.

2. The golf club according to claim 1, wherein the guide surface is integrally constructed with the intermediate piece.

3. The golf club according to claim 1, comprising means for adjusting the guide surface relative to the intermediate piece.

4. The golf club according to claim 1, wherein the guide surface comprises at least one leaf spring.

5. The golf club according to claim 4, wherein the guide surface comprises at least two overlapping leaf springs of different lengths.

* * * * *